United States Patent [19]

Hewson

[11] 3,987,837

[45] Oct. 26, 1976

[54] BI-FOLD DOOR ASSEMBLY

[76] Inventor: Kenneth E. Hewson, 33905 Lamoyne, Livonia, Mich. 48154

[22] Filed: Sept. 16, 1974

[21] Appl. No.: 506,220

[52] U.S. Cl. ..... 160/206; 16/169; 160/118

[51] Int. Cl.[2] ..... E05D 15/26

[58] Field of Search ..... 160/118, 206, 199; 16/168, 169

[56] References Cited

UNITED STATES PATENTS

| | | | |
|---|---|---|---|
| 1,208,422 | 12/1916 | Way | 16/169 X |
| 1,393,139 | 10/1921 | Kiesel, Jr. | 16/168 X |
| 2,882,962 | 4/1959 | Hollansworth | 160/206 X |
| 2,943,675 | 7/1960 | Ford | 160/206 |
| 3,187,800 | 6/1965 | Kirby | 160/206 |
| 3,233,657 | 2/1966 | Kirby | 160/206 |
| 3,378,058 | 4/1968 | Matyas | 160/206 X |
| 3,536,120 | 10/1970 | Kellems | 160/206 |
| 3,866,658 | 2/1975 | Smith | 160/206 |

*Primary Examiner*—Philip C. Kannan
*Attorney, Agent, or Firm*—Basile, Weintraub and Vanophem

[57] ABSTRACT

A bi-fold door assembly of the type adapted to be mounted in a doorway having opposing parallel jambs and a connecting header, the bi-fold door assembly including at least one jamb door pivotably secured to one jamb and a lead door having means hinging the same to the jamb door. In one embodiment, a header track having a U-shaped cross section having inner opposing legs with longitudinally disposed and transversely spaced flanges defining a longitudinal slot thereinbetween. The flanges slidably support a pivot assembly carried by the lead door to guide the lead door between its opened and closed positions. In one preferred embodiment, the door is fabricated from wood and is pivotably mounted at the door jamb side by means of a floor bracket assembly including means for selectively positioning the location of the pivot point on which is mounted a vertically adjustable support member carried by the door such that the height of the door may be selectively positioned as well as its location with respect to the door jamb.

In a second embodiment, a floor track, mounted to the floor has a U-shaped cross section with the legs thereof being provided with opposing flanges defining a longitudinal slot thereinbetween. A vertically adjustable pivot support member is carried by an element fixed to the floor track at a point near the door jamb, while the lead door is provided with a pivot assembly member slidably supported by the floor track. A plastic door is disclosed having a unique and novel manner for hinging the doors together so that the same may be easily assembled and disassembled. A spring member comprising a pair of spaced end members connected by a pair of invertedly disposed flexible members to form a spring which is used in one embodiment to ensure that the bi-fold doors remain in a closed position and, in an alternate embodiment, the spring member may be used as a spacer element.

4 Claims, 13 Drawing Figures

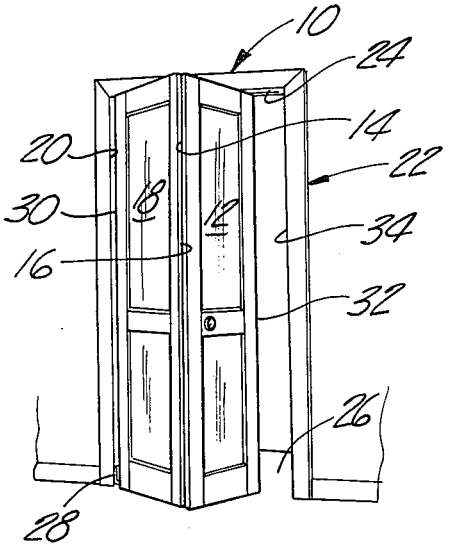
Fig-1
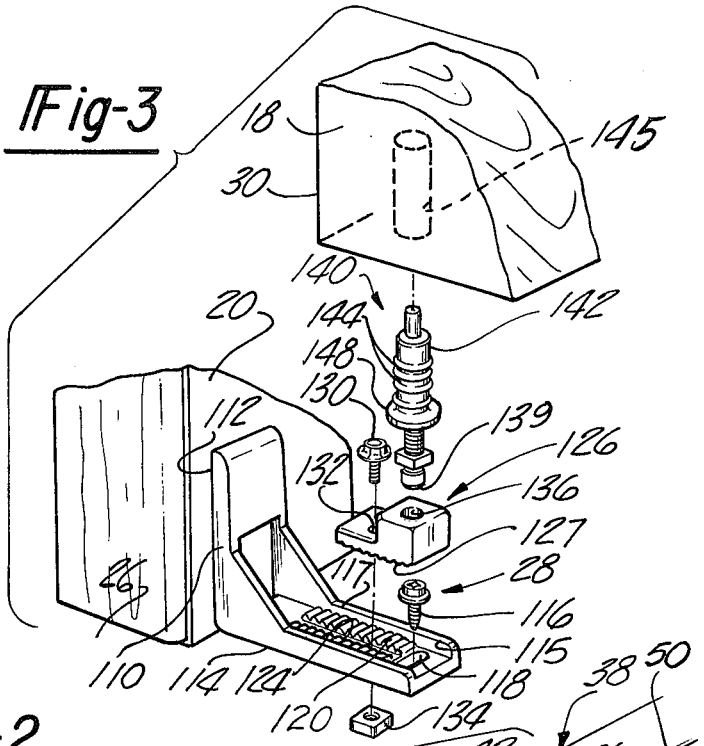
Fig-3
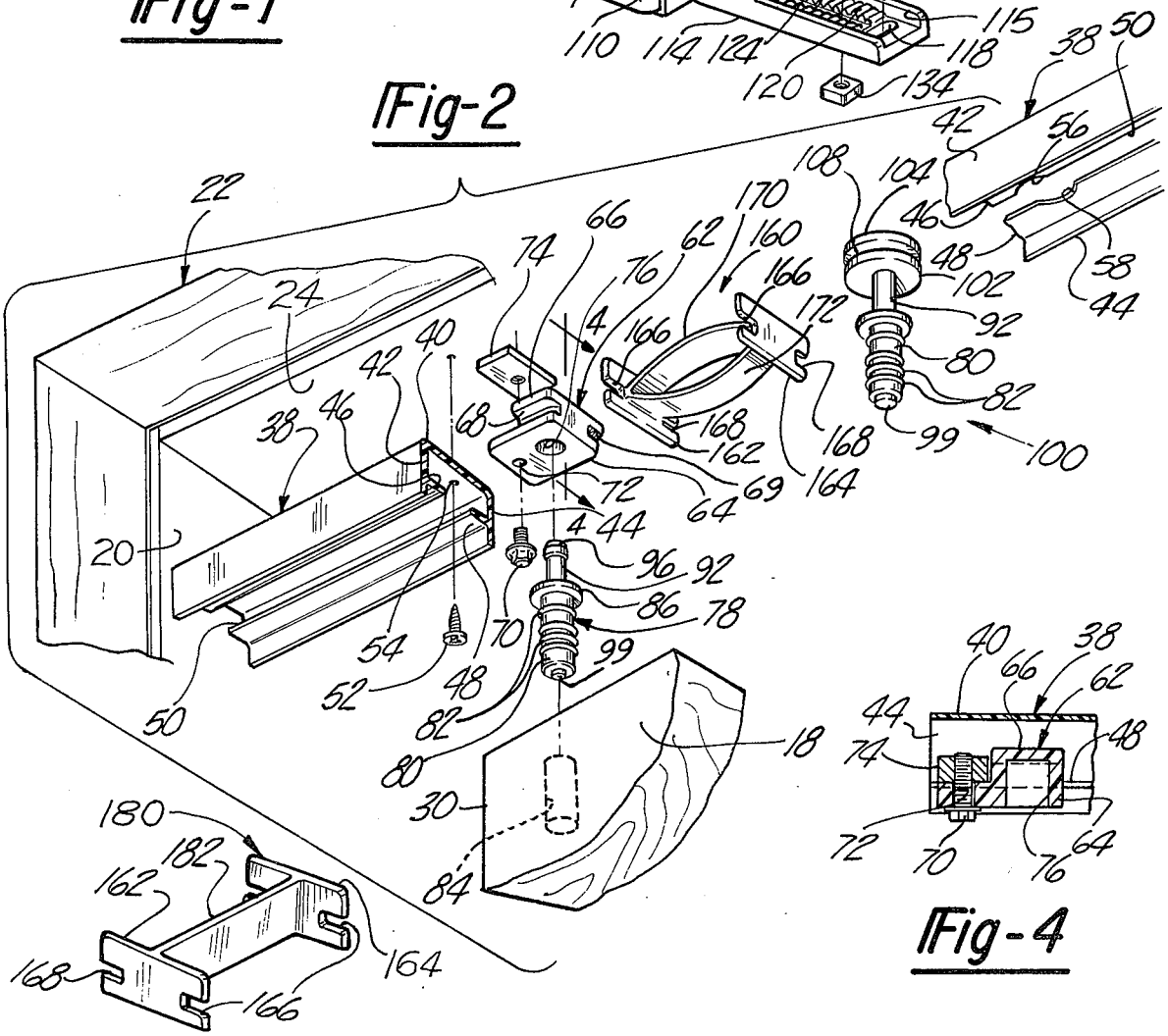
Fig-2
Fig-4
Fig-12

BI-FOLD DOOR ASSEMBLY

BACKGROUND OF THE INVENTION

I. Field of the Invention

The present invention relates to bi-fold door assemblies and, in particular, to hardware fabricated from plastic materials for the mounting of bi-fold doors and including a new plastic bi-fold door.

II. Description of the Prior Art

Bi-fold doors are well known and commonly used and, generally, comprise two wooden doors, one of which is a lead door that is hinged along its lengthwise edge of a jamb door which, in turn, has hinges for mounting the jamb door to the jamb of the doorway on which it is desired to use the bi-fold door. Generally, such bi-fold doors are fabricated from wood and are not provided with any means for guiding the forward end of the lead door such that the door may be opened and closed in a simple and easy manner without the lead door abutting the header of the door and causing damage to the wooden molding along the door header as is common in the use of such bi-fold doors.

In order to overcome this problem, it has been suggested in the past that the bi-fold door assembly be provided with a header track wherein the upper surface of the lead door is provided with an element that pivotably engages the header track such that the door is guided as it is opened and closed. Furthermore, spring elements have been employed to exert a tension on this pivot assembly such that when the door is closed it will remain in the closed position. Additionally, such prior art structures have included means for pivotably mounting the upper and lower surfaces of the jamb door, adjacent the jamb, to the header track and to the floor as opposed to using hinges along the lengthwise edges of the jamb door adjacent the jamb. This arrangement has proven fairly successful and, in particular, has provided means for adjusting the vertical height of the door as well as its position with respect to the door jamb. Although these bi-fold door assemblies have functioned in an acceptable manner, they are expensive to fabricate and are difficult to utilize, especially during the initial installation of the bi-fold door as well as during the removal of the doors in the event the same must be repaired or replaced.

SUMMARY OF THE INVENTION

The present invention, which will be described subsequently in greater detail, comprises a bi-fold door assembly having a header track on which is pivotably carried a member for guiding the lead door of the bi-fold assembly. In an alternate embodiment, a floor track is provided for guiding the lead door. Various components of the system including a novel spring arrangement and hinge arrangement integrally fabricated from a plastic material are also disclosed.

It is therefore an object of the present invention to provide a new and improved bi-fold door assembly having novel components for the mounting of the bi-fold doors and in which the plastic materials are incorporated so that the resulting bi-fold door assembly is of a simple and inexpensive construction and one which may be easily installed and removed, as desired.

Other objects, advantages, and applications of the present invention will become apparent to those skilled in the art of the manufacture and installation of bi-fold door assemblies when the following description of the best modes contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and in which:

FIG. 1 is a perspective view of a bi-fold door assembly mounted in a doorway;

FIG. 2 is an enlarged, fragmentary, exploded perspective view of several components utilized in the mounting of the bi-fold door assembly illustrated in FIG. 1 the components as viewed from left to right being a door jamb, a track assembly, a spring pivot assembly, spring means, a roller pivot assemby, and a notched section of an upper track assembly;

FIG. 3 is an enlarged fragmentary exploded view of several elements used in the mounting of the bi-fold door illustrated in FIG. 1 the elements being an L-shaped grooved bracket, a lower grooved pivot support base, and a lower pivot assembly;

FIG. 4 is a fragmentary cross-sectional view taken along line 4-4 of FIG. 5;

FIG. 12 is a perspective view of another element used in the assembly of the bi-fold door illustrated in FIG. 1.

DESCRIPTION OF THE PREFERRED EMBODIMENTS

Figure 6:
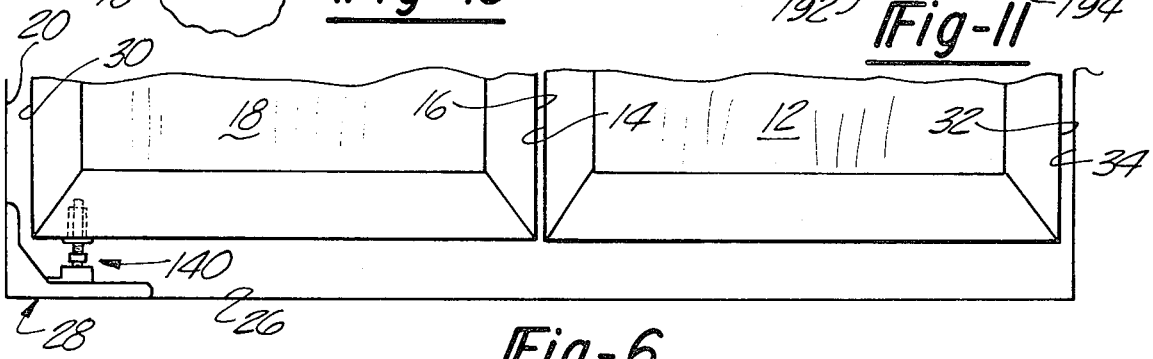
FIG. 6 is a fragmentary view of the bottom section of a bi-fold assembly of the type illustrated in FIGS. 1 and 3.

Referring now to the drawings and, in particular, to FIG. 1, wherein there is illustrated a bi-fold door assembly 10 comprsing a lead door 12 hinged along its lengthwise edge 14 to the lengthwise edge 16 of a jamb door 18. The jamb door 18, in turn, is pivotably mounted adjacent the jamb 20 of a doorway 22. Pivotable mounting of bi-fold door assembly 10 is accomplished by means of mounting the upper surface of the jamb door 18 to a header 24 (FIG. 2) of the doorway 22 by means of a header track 38 (FIG. 2) and to the floor 26 by means of a jamb pivot bracket 28. When the door 10 is in a closed position, the lengthwise edge 30 of the jamb door 18 is adjacent the jamb 20, while the lengthwise edge 32 (FIGS. 1, 6 and 7) of the lead door 12 is adjacent the other door jamb 34. The manner in which the bi-fold door assembly 10 is attached to the doorway 22 will be described in greater detail hereinafter.

Figure 5:
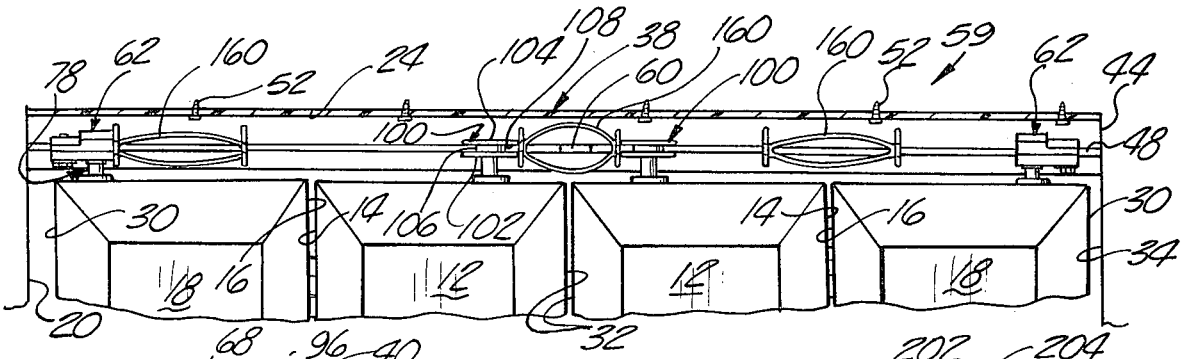
FIG. 5 is a fragmentary plan view, partially in section, illustrating a double bi-fold door arrangement.

Referring now to FIGS. 2 and 5, wherein there is illustrated in greater detail the header track 38 which comprises an elongated member having a U-shaped cross section including a base 40 and downwardly depending legs 42 and 44, the inner opposing surfaces of which have integrally formed thereon opposing flanges 46 and 48, respectively. The flanges terminate in opposing edges that define a lengthwise slot 50 for a purpose to be described hereinafter. The header track 38 is attached to the header 24 by any suitable means such as screws 52 passing through apertures 54 in the header base 40 and into the header 24. The header track 38 is so attached to the header 24 that it extends between the jambs 20 and 34. The header track flanges 46 and 48 are, respectvely, provided with arcuate notches 56 and 58 (FIG. 2) which define an enlarged slot between the flanges. In the bi-fold door assembly 10 shown in FIG. 1 the notches are located on the extreme right-hand portion of the header track 38 immediately adjacent the jamb 34. In the double bi-fold door assembly 59 illustrated in FIG. 5, the enlarged header track slot defined by the arcuate notches 56 and 58 is located in the header track 38 at its midsection, as noted by the numeral 60, all of which is for a purpose to be described hereinafter.

In the embodiment to be described hereinafter and specifically with respect to the arrangement illustrated in FIGS. 1 through 5, the same has particular application in the mounting of bi-fold doors fabricated from wood. However, as will be seen hereinafter, many of the components utilized in the mounting of a wooden bi-fold door have equal application in the mounting of a door fabricated from plastic materials.

As can best be seen in FIGS. 2 and 4, the bi-fold door assembly 10 has a header track pivot support 62 which comprises an integral section having an enlarged base 64 connected to an upper portion 66 and which define on opposite sides thereof a pair of recesses 68 and 69 which are, respectively, adapted to receive the opposing edges of the header track flanges 46 and 48 such that the header track pivot support 62 may be slidably moved along the full length of the header track, if desired or fixed in place as will be described. In the embodiment illustrated, the header track pivot support 62 is positioned near the jamb 20 and fixed in place. This is accomplished by means of a threaded member 70 that extends through an aperture 72 in the base 64 and threadedly engages a fastening element 74 such such that the element 74 clampingly engages the flanges 46 and 48 against the upper surface of the base 64 and retains the pivot support 62 in position. The base 64 is provided with an enlarged bore 76 which is adapted to receive the extended rounded end 96 of a spring pivot assembly 78.

Figure 9:
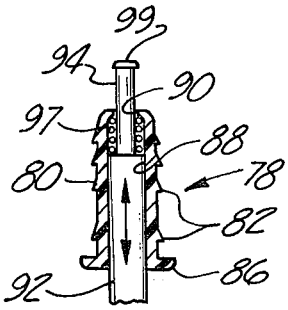
FIG. 9 is a longitudinal cross-sectional view through a spring pivot assembly of the type illustrated in FIG. 2.

The spring pivot assembly 78 is illustrated in FIG. 2 in position for pivotably attaching the jamb door 18 to the header track 38, while in FIG. 9 it is shown in cross section and in position for attaching the bi-fold door to a floor track 190 which will be described hereinafter in greater detail. As can best be seen in FIGS. 2 and 9, the spring pivot assembly 78 comprises an elongated housing 80 having on the outer surface thereof a plurality of axially spaced flange elements 82 which when utilized in conjunction with a wooden door provide a press-type fit of the housing 80 into a bore 84 of the door (FIG. 2) for securely attaching the spring pivot assembly 78 to the door. The housing 80 is further provided with an enlarged head 86 which limits the inward movement of the spring pivot assembly 78 into the door groove 84 as the outer surface of the head 86 abuts the upper surface of the door. The housing 80 is provided with a longitudinal bore 88 (FIG. 9) which terminates in a decreased diameter bore 90. A stem member 92 is slidably mounted in the bore 88 and is provided with a decreased diameter portion 94 that extends through the bore 90. A spring 97 is disposed between the stem 92 and the bottom wall of the housing 80 and biases the stem 92 outwardly for a purpose to be described. The upper end 96 of the stem 92 is enlarged and rounded and adapted to be received within pivot support bore 76 and pivotably supported thereby. The abuttment of the other enlarged end 99 against the end of the housing limits the outward movement of the stem 92 against the bias of spring 97.

The bi-fold door assembly is further provided a roller pivot assembly 100 having housing 80, stem portions 92 and 94 and an internal configuration which is identical to the aforementioned spring pivot assembly 78 and like components are referred to by the same numeral. The roller pivot assembly 100 differs in that the upper end, instead of terminating in a rounded end 96, is provided with a pair of vertically spaced, horizontally disposed disc members 102 and 104 (FIG. 2) which are interconnected by a central stem portion 106 (FIGS. 5 and 7) so as to define between the opposing surfaces of the discs 102 and 104 a circular recess 108. The circular recess 108 is adapted to receive the flanges 46 and 48 so that the entire roller assembly 100 is slidably movable along the length of the header track 38. The aformentioned notched sections 56 and 58 of the header track 38 are so sized as to permit the disc 104 to pass through the slot 50 and permit engagement of the flanges 46 and 48 with the recess 108. This is necessary as the roller pivot assembly 100 is first attached to the bi-fold doors prior to attachment to the header track 38 which, in turn, has been previously attached to the header 24 during the assembly of the door. The manner in which the door is assembled and in which the various components of the bi-fold door assembly are utilized will be explained in greater detail hereinafter, after description of several components of the bi-fold door. The roller pivot assembly 100 is normally attached to the upper surface of the lead door 12 at a position slightly inwardly spaced from the leading edge 32 such that the roller pivot assembly 100, when engaged with the flanges 46 and 48 of the header track guides the door as it is opened and closed while the rear edge 30 of the jamb door 18 is pivoted by means of the spring pivot assembly 78 being carried within the pivot support bore 76.

While the upper portions of the jamb door 18 and lead door 12 are carried by the header track 38 in the aforementioned manner, the lower portion of the jamb door 18 in the embodiments illustrated in FIGS. 1 through 6 is pivotably supported by means of the aforementioned jamb pivot bracket 28. The pivot bracket 28, which can best be seen in FIG. 3, comprises an L-shaped member 110 having a leg 112 abutting the jamb 20 and, if desired, attached thereto by any suitable fastener, while the other leg 114 abuts the floor 26 and is attached thereto by means of a threaded fastener 116 that extends through an aperture 118 at the forward end of the leg 114. The upper surface of the leg 114 is recessd at 115 through its full length to form walls 117. The bottom of the recess 115 has two parallel sets of successively spaced grooves and projections 120 which are separated by a longitudinal slot 124.

The jamb bracket 28 further comprises a base pivot support 126, the lower surface of which is provided with a mating set of successively spaced grooves and projections 127 which mate with the aforementioned grooves and projections 120 on the leg 114 when the base pivot support 126 is positioned thereon. The grooves which permit the pivot support 126 to be positioned at numerous selected locations along the full length of the leg 114 restrain the base pivot support 126 from lengthwise movement with respect to the leg 114 while the side walls 117 restrain the pivot support 126 from transverse movement once the same is positioned in a desired location with respect to the jamb 20. A threaded fastener 130 extending through an aperture 132 in the pivot support 126 and the elongated slot 124 threadedly engages a nut 134 on the bottom of the leg 114 to securely lock the pivot support 126 in place. The bottom surface (not shown) of the leg 114 is recessed so as to provide positioning of the nut 134 without interference of the floor 26. The upper surface of the base pivot support 126 is provided with a bore 136 adapted to receive the rounded end 139 of a vertically adjustable pivot assembly 140 such that the pivot assembly 140 is pivotably supported in the bore 136.

The pivot assembly 140 which is best illustrated in FIGS. 3, 6, 7 and 8 comprises an elongated housing 142 which is similar in construction to the aforementioned spring pivot assembly 78 in that the outer surface of the housing 142 is provided with a plurality of circumferentially disposed and axially spaced flanges 144 which are adapted to be press fitted into a bore 145 (FIG. 3) of the lower edge of the jamb door 18 at a location inwardly spaced from the jamb 20. The housing 144 is provided with an enlarged head 148 which abuts the bottom surface of the jamb door to limit the insertion of the pivot assembly 140 into the bore 145. The housing 144 of the pivot assembly 140 is provided with a longitudinal bore 146 FIG. 8 which is threaded to threadedly receive the threaded portion 152 of a support stem 154, the lower end 139 of which is rounded and adapted to be seated for pivotal movement in the bore 136 of the base pivot support 126, as aforementioned. Immediately above the rounded end 136, the stem 154 is provided with a hexagonal head 156 adapted to be received in a complementary shaped wrench so that the stem 154 may be rotated and threaded into the housing 144 when in position within the jamb door bore 146 so that the jamb door 18 may be selectively raised or lowered with respect to the bracket 28 to properly orient the jamb door 18.

As can best be seen in FIGS. 2 and 5, the bi-fold door assembly 10 further comprises a spring spacer member 160 which comprises a pair of end members 162 and 164. Each end member has a pair of inwardly disposed notches 166 and 168 extending inwardly from the side edges of each end member. It should be noted that the notches, which are aligned, are disposed closer to the bottom edges of the end members 162 and 164. The notches 166 and 168, respectively, receive the header track flanges 46 and 48 such that the spring 160 is slidably supported thereon. The end members 162 and 164 are connected by a pair of flexible spring members 170 and 172, the ends of each spring member being connected to the opposing inner surfaces of the end members 162 and 164 in the space between the inner edges of the notches 166 and 168. The flexible members are so fabricated that they have an outwardly directed bend thereto and when a force is directed to move the end members 162 and 164 toward each other, the spring members 170 and 172 are flexed outwardly and when the aforementioned force is relieved, the bias of the spring members 170 and 172 urges the end members 162 and 164 back to their original position with respect to each other. The spring member 160 is preferably of integral construction and fabricated from a plastic material with the spring members 170 and 172 having sufficient resiliency to function in the aforementioned spring-like manner. As can best be seen in FIG. 5, the spring member 160 is slidably mounted in the header track between the fixed pivot support 62 and the movable roller pivot assembly 100 such that when the door is open the roller abuts the spring 160 and its opening movement by the user of the door is cushioned. Similarly, a spring 160 disposed on the header track 38 between the rollers 100 carried by leading edges of the lead door 12 such that when the two doors are brought to their closed position as illustrated in FIG. 5, the spring 160 is compressed by the action of the rollers acting on either side thereof to exert a biasing force against the rollers 100 and thus maintaining the doors in a closed position.

In FIG. 12 there is illustrated an alternate arrangement of a spacer member 180 which is adapted to be positioned between the fixed header track pivot support 62 and the roller pivot assembly 100. The spacer member 180 comprises the aforementioned end members 162 and 164, each having the opposing notches 166 and 168 which in turn are adapted to be slidably supported by the flanges 46 and 44 of the header track 38. The opposing end members 162 and 164 of the spacer member are connected by a single flexible element 182 and functions in a manner similar to the spring member 160 except that it does not have the same amount of resiliency and is usable as a spacer in the aforementioned manner. The spacer member 180 is of an integral construction and preferably fabricated from a plastic material.

Figure 13:
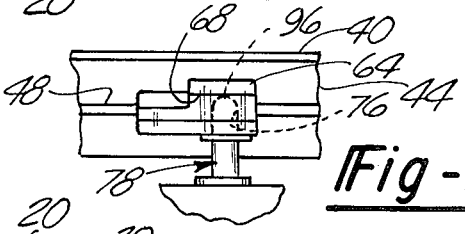
FIG. 13 is a fragmentary view of an alternate embodiment of a pivot assembly adapted to be used in the embodiments illustrated through the several figures of the drawings.

Referring now to FIG. 13 wherein there is illustrated the base portion 64 of the header track pivot support member 62 wherein the clamping member 74 and screw 30 have been eliminated. With this arrangement, the header track pivot support 62 is free for slidable movement along the length of the track. In this manner, the roller pivot assembly 100 may be eliminated and the aforementioned spring pivot assembly 78 may be attached to the upper surface of the forward edge of the lead door 12 and the round head 96 thereof being pivotably carried by the bore 76 of the pivot support base portion 64 wherein the doors function in the same manner as described with respect to the embodiment illustrated in FIG. 5.

Figure 11:
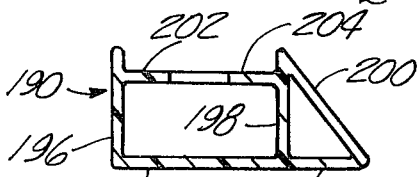
FIG. 11 is a cross-sectional view through the base track taken along line 11—11 of FIG. 7.
Figure 7:
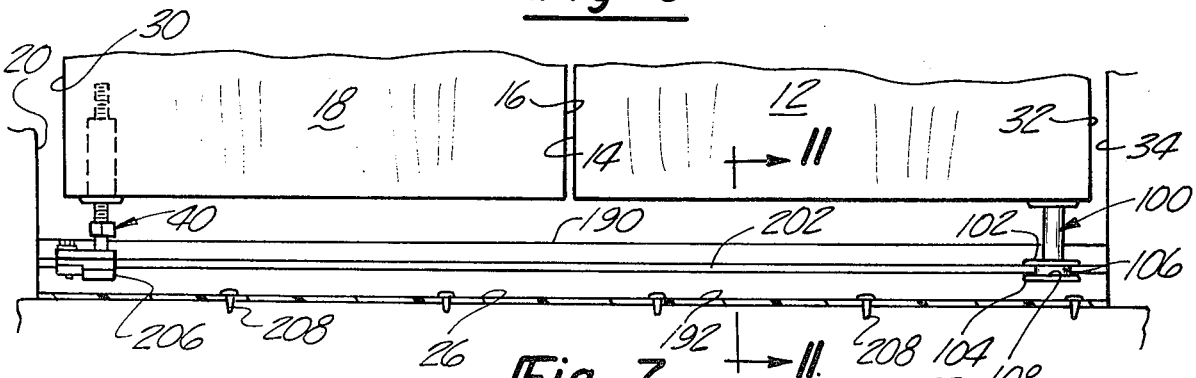
FIG. 7 is a bottom plan view of alternate arrangement of a bi-fold door assembly.
Figure 8:
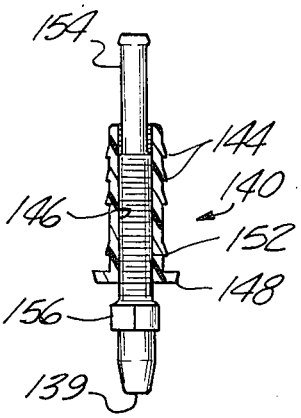
FIG. 8 is a longitudinal cross-sectional views of a vertically adjustable pivot assembly of the type illustrated in FIG. 3.

Referring now to FIGS. 7 and 11 wherein there is illustrated the floor track 190 which is similar to the aforementioned header track 38 in that the base track 190 comprises an elongated member having a U-shaped cross section with a base 192 having a lateral extending portion 194 and upwardly extending legs 196 and 198, the upper lengthwise edge of the leg 198 being connected to the lengthwise edge of the extension 194 by an inclined connecting member 200 to form a cover which provides a better appearance for the floor track 190 as the same is mounted on the floor 26 of a door which is normally used as a closet door, and thus entry and egress into and out of the closet is easily facilitated as the inclined surface on the base track prevents a person from tripping over the track. The legs 194 and 198 of the track 190 are provided with opposing flanges 202 and 204 which function in the same manner as the flanges 46 and 48 of the header track 38 in that the flanges 202 and 204 are adapted to slidably support a roller pivot assembly 100 which, in turn, is adapted to be mounted to the forward lower portion of the lead door 12 to guide the same when the door is opened and closed. On the left end of the floor track 190, as viewed in FIG. 7, a pivot support 206 is fixedly mounted to the track and is identical in construction to the aforementioned pivot support 62. A vertically adjustable pivot assembly 140 is mounted in the pivot support 206 and supports the left edge of the jamb door 18 in the identical manner as hereinbefore described with respect to the adjustable pivot assembly 140. The base 192 of the floor track 190 is attached to the floor 26 by any suitable means such as screws 208 that extend through the base 192 and into the floor 26.

Figure 10:
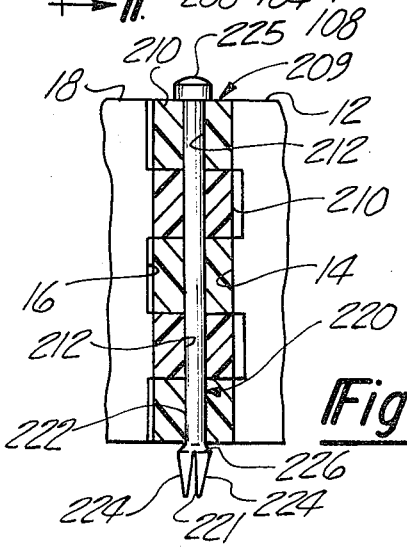
FIG. 10 is a fragmentary cross-sectional view through the bi-fold door assembly illustrated in FIG. 1 showing the manner in which the bi-fold doors are hinged.

The door illustrated in FIG. 7 is preferably of a plastic construction and as illustrated in FIG. 10, the hinges 209 along the edge 16 of the jamb door 18 are integral molded projections 210 each having a cylindrically shape bore 212, while similarly the lengthwise edge 14 of the lead door 12 is provided with integral projections 210 having cylindrical bores 212, the projections 210 being intermeshed in a conventional manner to form the hinge 209. The hinged sections 210 are connected to each other for relative pivotal movement by means of a hinge pin 220. The hinge pin 220 comprises an elongated circular rod 222, the upper end 225 of which is enlarged so as to abut the upper surface of the cylindrical section 210 to limit the downward movement of the hinge pin 220 through the longitudinal bores 212 defined by the aligned projections 210. The bottom end of the hinge pin 220 is provided with a longitudinally disposed V-shaped groove 221 defined by a pair of forks 224. The forks 224 have tapered outer surfaces which terminate at a step 226. It can be seen that as the rod 222 is inserted through the longitudinal bores 212 the tapered ends 224 of the rod 222 are pressed inwardly such that the step 226 is reduced in diameter for the easy passage of the rod 222 downwardly through the hinge bores 212 and whereupon the forked tapered ends 224 expand and the step 226 will engage the lower surface of the hinge portion 210 to prevent removal of the rod 222 unless desired. Removal of the rod 222 can be obtained simply be compressing the tapered ends 224 toward each other until the diameter of the step 226 is decreased to a point less than the diameter of the bore 212.

The pin 220 is preferably constructed from a plastic material with the forked ends 224 being of an integral construction and the material being resilient enough to permit the forked ends to be flexed in the aforementioned manner without damage thereto.

In use the pivot assemblies are attached to the upper and lower surfaces of the lead and jamb doors in the aforementioned manner with the roller pivot assembly 100 being inserted through the slot 50 by means of the notches 56 and 58 while the head 96 of the pivot assembly 78 is inserted with the pivot support 62. The doors are pushed upwardly to compress the springs 97 permitting the doors to be raised a sufficient distance so as to allow engagement of the adjustable support 140 with the bracket support 28.

It can thus be seen that the present invention has disclosed a new and improved bi-fold door assembly havng all the advantages stated hereinbefore in the Summary of the Invention and which bi-fold door assembly has numerous advantages over the aforementioned prior art apparatus.

Although several forms of the present invention have been shown, it should be apparent to those skilled in the art in bi-fold door assemblies, other forms can be had all coming within the spirit of the invention and the scope of the appended claims.

It should be noted that all of the components aforementioned may be fabricated from a plastic material.

What is claimed is as follows:

1. A bi-fold door assembly adapted to be mounted in a doorway having opposing jambs and a header, said bi-fold door assembly comprising:

a jamb door;

a lead door;

means for hinging one lengthwise edge of said jamb door to one lengthwise edge of said lead door;

a header track having a U-shaped cross-section with a base having downwardly disposed legs;

the base of said track being attached to said door header such that said base extends from one of said door jambs, the opposing inner surfaces of said legs each having inwardly directed flanges formed thereon and extending the full length of said track, the upper surfaces of said flanges being spaced from said base a predetermined distance and the opposing edges of said flanges defining a slot;

means pivotably attaching a portion of said jamb door adjacent the other lengthwise edge thereof to said track at pivot point adjacent said one door jamb;

a pivot assembly carried by the upper surface of said lead door at a point adjacent the other lengthwise edge thereof, said pivot assembly having a stem member extending from said lead door through said slot and terminating in an enlarged head greater than said slot and slidably supported by the upper surfaces of said flanges, said track flanges having a notched section for the passage of said enlarged head through said slot for said slidable support by said upper surfaces of said flanges, said notched section being spaced from said first-mentioned pivot point on said header track a distance which is greater than the distance between said pivot point and said pivot assembly when said doors are in a closed position;

First spring means carried by said header track at a position between said other door jamb and said pivot assembly;

second spring means carried by said header track between said first pivot point and said pivot assembly, said first and second spring means comprising a pair of spaced parallel end members each having a pair of aligned notches slidably receiving said flanges of said track and supported thereby, and a pair of flexible members connecting the inner opposing surfaces of said spaced end members, said flexible members having a width less than said slot such that at least one of said members is expansible away from the other and through said slot when said end members are forced toward one another, said flexible members urging said end members away from each other.

2. A bi-fold door assembly adapted to be mounted in a doorway having opposing jambs and a header, said bi-fold door assembly comprising;

a jamb door;

a lead door;

means for hinging one lengthwise edge of said jamb door to one lengthwise edge of said lead door;

a header track having a U-shaped cross-section with a base having downwardly disposed legs;

the base of said track being attached to said door header such that said base extends from one of said door jambs, the opposing inner surfaces of said legs each having inwardly directed flanges formed thereon and extending the full length of said track, the upper surfaces of said flanges being spaced from said base a predetermined distance and the opposing edges of said flanges defining a slot;

means pivotably attaching a portion of said jamb door adjacent the other lengthwise edge thereof to said track at a pivot point adjacent said one door jamb;

a pivot assembly carried by the upper surface of said lead door at a point adjacent the other lengthwise edge thereof, said pivot assembly having a stem member extending from said lead door through said slot and terminating in an enlarged head greater than said slot and slidably supported by the upper surfaces of said flanges, said track flange having a notched section for the passage of said enlarged head through said slot for said slidable support by said upper surfaces of said flanges, said notched section being spaced from said first-mentioned pivot point on said header track a distance which is greater than the distance between said pivot point and said pivot assembly when said doors are in a closed position;

spring means carried by said header track at a position between said other door jamb and said pivot assembly;

second spring means carried by said header track between said first pivot point and said pivot assembly;

spacer means comprising a pair of spaced parallel end members each having a pair of aligned notches slidably received within said flanges and supported thereby; and a flexible member connecting the inner opposing surfaces of said spaced end members, said flexible member being disposed in a plane which is perpendicular to said flanges and movable toward one of said flanges when said end members are moved toward each other such that said flexible member exerts a force on said end members to move said end members away from each other.

3. A bi-fold door assembly adapted to be mounted in a doorway having jambs and a header, said bi-fold door assembly comprising:

a jamb door;

a lead door;

means for hinging one lengthwise edge of said jamb door to one lengthwise edge of said lead door;

a header track having a U-shaped cross-section with a base and downwardly disposed legs, the base of said track being attached to the header of said door such that said track extends from one of said door jambs, the opposing inner surfaces of said legs each having inwardly directed flanges formed thereon and extending the full length of said track, the upper surfaces of said flanges being spaced from said base a predetermined distance and the opposing edges of said flanges defining a slot thereinbetween;

a floor track having a U-shaped cross-section with a base and upwardly disposed legs, the base of said floor track being attached to the floor below said header of said door such that said floor track extends from said one door jamb, the opposing inner surfaces of said legs each having inwardly directed flanges formed thereon and extending the full length of said floor track, the lower surfaces of said flanges being spaced from said base a predetermined distance and the opposing edges of said flanges defining a slot thereinbetween;

means pivotally attaching the upper and lower portions of said jamb door adjacent the other lengthwise edge thereof respectively to said header track and said floor track at pivot points adjacent said one door jamb;

pivot assemblies respectively at the upper and lower surfaces of said lead door at a point adjacent said other lengthwise edge of said lead door, said pivot assemblies having means extending into said slots for guiding said door as said door is opened and closed;

said pivot assembly carried on the upper surface of said lead door comprising a stem member extending from said lead door through said slot and slidably supported by the upper surfaces of said flanges, said header track flange having a notched section for the passage of said enlarged head through said slot, said notched section being spaced from said first-mentioned pivot point at the upper surface of said jamb door a distance which is greater than the distance between said pivot point and said pivot assembly at said upper surface of said lead door when said doors are in a closed position; and a pair of spaced members each having opposing recesses which slidably receive the flanges of said header track, said members being spaced a predetermined distance and connected by a flexible member, said flexible member having a width less than said slot such that said flexible member is expansible up and down through said slot when a force is brought to bear against said spaced members.

4. The bi-fold door assembly defined in claim 3, wherein said last-mentioned spaced members are disposed between the other door jamb and said pivot assembly in said header track.

* * * * *

UNITED STATES PATENT AND TRADEMARK OFFICE

CERTIFICATE OF CORRECTION

PATENT NO. : 3,987,837

DATED : October 26, 1976

INVENTOR(S) : Kenneth E. Hewson

It is certified that error appears in the above-identified patent and that said Letters Patent are hereby corrected as shown below:

Column 2, line 33, after "cross-sectional" delete "views"and insert --view--;

Column 4, line 3, after "door" delete "groove" and insert --bore--;

Column 8, line 52, preceding "spring" delete "First" and insert --first--;

Column 10, line 36, after "and" insert -- terminating in a enlarged head greater than said slot and--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*